United States Patent [19]

Broom

[11] 4,226,700

[45] Oct. 7, 1980

[54] METHOD FOR INHIBITING FOULING OF PETROCHEMICAL PROCESSING EQUIPMENT

[75] Inventor: Henry T. Broom, Richmond, Tex.

[73] Assignee: Nalco Chemical Company, Oakbrook, Ill.

[21] Appl. No.: 932,855

[22] Filed: Aug. 14, 1978

[51] Int. Cl.[2] ..... C10G 9/16

[52] U.S. Cl. ..... 208/48 AA; 106/14.27; 106/14.31; 106/14.42; 106/14.43; 585/4

[58] Field of Search ..... 106/14.27, 14.31, 14.42, 106/14.43; 252/45; 208/48 AA; 260/666.5, 45.85 H, 45.85 S; 585/4

[56] References Cited

U.S. PATENT DOCUMENTS

| | | | |
|---|---|---|---|
| 3,245,949 | 4/1966 | Murdock | 260/45.85 S |
| 3,297,631 | 1/1967 | Brown et al. | 260/45.85 S |
| 3,428,598 | 2/1969 | Matsubayashi et al. | 260/45.85 H |
| 3,487,044 | 12/1969 | Tholstrup | 260/666.5 |
| 3,645,886 | 2/1972 | Gillespie et al. | 208/48 AA |
| 4,024,048 | 5/1977 | Shell et al. | 208/48 AA |
| 4,024,049 | 5/1977 | Shell et al. | 208/48 AA |
| 4,024,050 | 5/1977 | Shell et al. | 208/48 AA |
| 4,024,051 | 5/1977 | Shell et al. | 208/48 AA |
| 4,105,619 | 8/1978 | Kaufman et al. | 260/45.85 H |

*Primary Examiner*—Lorenzo B. Hayes

*Attorney, Agent, or Firm*—Kinzer, Plyer, Dorn & McEachran

[57] ABSTRACT

Method for inhibiting the formation of foulants on petrochemical equipment which involves adding to the petrochemical, during processing, a composition comprising a thiodipropionate and either a dialkyl acid phosphate ester or a dialkyl acid phosphite ester.

1 Claim, No Drawings

METHOD FOR INHIBITING FOULING OF PETROCHEMICAL PROCESSING EQUIPMENT

This invention relates to a method of treating petrochemicals being processed at a high temperature and to the composition of matter used for the treatment. The term petrochemical embraces crude petroleum (crude Oil) processed such as naphtha.

Petrochemicals are usually processed at high temperatures conducive to accumulation of foulants on the inside of the processing pipes and vessels. The foulant of whatever form restricts flow of the petrochemical and interferes with heat transfer, reducing process efficiency.

The primary object of the present invention is to inhibit fouling in petrochemical process equipment and to accomplish this by treating the petrochemical with an oil soluble mixture of thiodipropionate and either (1) dialkyl phosphate or (2) dialkyl phosphite. As will be shown hereinafter the mixture of the thiodipropionate compound and the phosphorus compound reduces fouling on a metal (e.g. steel) surface by a greater degree than either compound alone.

In gathering the data presented in the following tables twenty-four inch steel tubes having a heater on the inside were immersed in the petrochemical (circulated) and held there for the same time at the temperature indicated. The tubes were withdrawn and carefully observed for redcuction of fouling compared to a like tube immersed in the untreated petrochemical. From the observation the percent reduction in fouling is calculated.

TABLE 1

DIBUTYL ACID PHOSPHATE (DBP) AND DITRIDECYL THIODIPROPIONATE (DTP)
FEED: MOBIL-BEAUMONT DESALTED CRUDE
(70% MCX + 30% MURBON BERRI)

| Temperature: 500 degrees F. Antifoulant Treatment (Additive to the Feed) | Phosphorus PPM | Fouling % Reduction |
|---|---|---|
| DBP, 250 ppm 20% active | 7.5 | 56 |
| DBP, 500 ppm, 20% active | 15 | 85 |
| DBP, 250 ppm, 20% active + DTP, 10 ppm | 7.5 | 86 |
| DBP, 500 ppm, 20% active + DTP, 20 ppm | 15 | 86 |
| DTP, 4% 470 ppm | — | 22 |
| DTP, 4% 940 ppm | — | 52 |

All the additives in Table 1 were dissolved in a kerosene type solvent (e.g. Exxon oil 3513) merely to aid in dispersing the active ingredient. The solvent may be any oil or mixture of oils ranging from light gasoline to heavy fuel oil; it is only a matter of cost.

It can be seen from Table 1 that DBP itself (7.5 ppm) reduced the amount of fouling on the outside of the tube by over fifty percent; when DTP was added, the amount of fouling was reduced by over eighty-five percent. In comparison, the diproprionate (DTP) by itself, and in large doses, was less effective than the phosphate by itself and the mixture as well.

In the event the user may be concerned about the acidic nature of the treatment, a base or neutralizer may be added to the mixture which neither aids nor detracts materially from the effects exhibited by the data in Table 1. The neutralizer may be methoxyproplyamine or an equivalent primary amine playing the passive role of neutralizer.

Dibutyl acid phosphite or isooctyl acid phosphate may be substituted for dibutyl acid phosphate with equally good results when treating the above-identified crude oil.

The treatment for preventing fouling of a crude oil is also effective when applied to a petroleum derivative such naphtha tested in the same manner:

TABLE 2

NAPHTHA FEED-NITROGEN BLANKETED PRIOR TO TESTING

| Temperature: 600 degrees F. Antifoulant Additive to the Feed (1000 ppm) | Fouling % Reduction |
|---|---|
| Dibutyl acid phosphite (8%) + DTP (2%) | 79 |
| 20% DTP | 77 |
| Diisooctyl acid phosphate (20%) + DTP (4%) | 36 |

The data in Table 2 also show that with some petrochemicals an acid phosphite may be superior to an acid phosphate in the role of antifoulant. This is verified by the data in Table 3 where the naphtha was aerated before testing which should result in oxidation and therefore elimination of some of the foulant precursors:

TABLE 3

NAPHTHA FEED-AERATED PRIOR TO TESTING

| Temperature: 600 degrees F. Antifoulant Additive to Feed (All doses 1000 ppm) | Fouling % Reduction |
|---|---|
| Dibutyl acid phosphite (8%) + DTP (2%) | 91 |
| Dibutyl acid phosphite (10%) | 90 |
| Diisooctyl acid phosphate (20%) + DTP (4%) | 56 |
| 20% DTP | 50 |

Thus, the past history of the naphtha, exhibiting more or less tendency to foul at high temperature, may have to be taken into account in terms of trial and error for selecting a phosphate or phosphite to be combined with the propionate. This is also true of crude oils because crudes are specific: Texas crude, Illinois crude, Trinidad crude, Arabic crude and so on, each having its own tendency to exhibit more or less fouling. However, this is a mere matter of sampling the petrochemical and conducting a test to determine whether the phosphate or the phosphite should be used. The strength of the oil solution (2%, 4%, 20% and so on) is not important since parts per million (ppm) represents the effective treatment and that is a matter of feed rate. The feed rate of dosage is thus determined by the percent solution (all in weight percent above).

The antifoulant additive may be injected into the process stream at any point upstream of the application of high temperature.

The phosphates and phosphites identified in the tables represent typical selections from equivalent, known organophosphorus ester compounds employed as petrochemical antifoulants disclosed in U.S. Pat. Nos. 4,024,048, 4,024,049, 4,024,050 and 4,024,051. Thus, the organophosphate which may be synergistically combined with the thiodipropionate subscribes to the formula

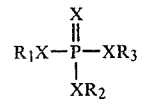

where:

X is sulfur or oxygen, $R_1$, $R_2$, and $R_3$ are each individually selected from the group consisting of hydrogen and addition complexes of hydrogen with an amine, alkyl, aryl, alkaryl, cycloalkyl, alkenyl, and aralkyl provided that in any given such phosphate ester at least one and not more than two of each $R_1$, $R_2$ and $R_3$ are hydrogen or an addition complex of hydrogen with an amine.

Similarly, the organophosphite compound which may be synergistically combined with the thiodipropionate subscribes to the formula

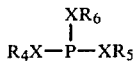

where:

X is sulfur or oxygen, and $R_4$, $R_5$, and $R_6$ are each individually selected from the group consisting of hydrogen, addition complexes of hydrogen with an amine, alkyl, aryl, alkaryl, cycloalkyl, alkenyl, and aralkyl, provided that in any given such phosphite ester at least one and not more than two of each $R_1$, $R_2$, and $R_3$ are hydrogen or an addition complex of hydrogen with an amine.

An alkyl chain of four to eight carbon atoms is preferred of both the phosphate and phosphite only because such compounds are easily dissolved in an inexpensive kerosene-type oil.

Any thiodipropionate commercially available may be used, subscribing to the formula

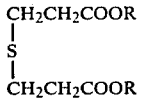

The ditridecyl species (R is a branched thirteen carbon chain) is preferred because it has a low freezing point and hence may be shipped and stored without apprehension in that regard. Thus, the R group in the thiodipropionate may be any alkyl group.

I claims:

1. A method of inhibiting formation of a foulant on process equipment through which a stream of hot crude oil or naphtha is fed and comprising adding to the stream an effective amount of a mixture consisting essentially of (1) a thiodipropionate and, (2) either a dialkyl acid phosphate ester or dialkyl acid phosphite ester, said phosphate ester being characterized by the general formula

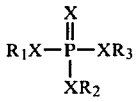

where:

X is sulfur or oxygen, $R_1$, $R_2$, and $R_3$ are each individually selected from the group consisting of hydrogen and addition complexes of hydrogen with an amine, alkyl, aryl, alkaryl, cycloalkyl, alkenyl, and aralkyl provided that in any given such phosphate ester at least one and not more than two of each $R_1$, $R_2$ and $R_3$ are hydrogen or an addition complex of hydrogen with an amine; and said phosphite ester being characterized by the general formula

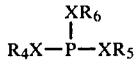

where:

X is sulfur or oxygen, $R_4$, $R_5$, and $R_6$ are each independently selected from the group consisting of hydrogen and addition complexes of hydrogen with an amine, alkyl, aryl, alkaryl, cycloalkyl, alkenyl, and aralkyl, provided that in any given such phosphite ester at least one and not more than two of each $R_4$, $R_5$, and $R_6$ are each hydrogen or an addition complex of hydrogen with an amine.

* * * * *